United States Patent [19]

West et al.

[11] Patent Number: 4,635,862

[45] Date of Patent: Jan. 13, 1987

[54] ROTARY COMMINUTOR

[75] Inventors: G. Allan West, North Kingstown, R.I.; William W. Barnes, Canton, Mass.; Thomas J. Dumaine, North Attleboro, Mass.; Herbert K. Andrews, Northbridge, Mass.

[73] Assignee: Nelmor Co., Inc., North Uxbridge, Mass.

[21] Appl. No.: 611,480

[22] Filed: May 17, 1984

[51] Int. Cl.[4] ..... B02C 23/10

[52] U.S. Cl. ..... 241/51; 241/74; 241/285 R; 241/285 A

[58] Field of Search ..... 241/51, 56, 60, 74, 241/242, 243, 285 R, 285 A, 285 B

[56] References Cited

U.S. PATENT DOCUMENTS

| | | | |
|---|---|---|---|
| 1,847,990 | 3/1932 | Stoner | 241/285 B X |
| 2,325,101 | 7/1943 | Bonnafoux | 241/51 |
| 3,549,093 | 12/1970 | Pallman | 241/73 X |
| 3,738,585 | 6/1973 | Berland et al. | 241/188 R X |
| 4,140,282 | 2/1979 | Steimel | 241/188 R X |
| 4,214,713 | 7/1980 | Wright | 241/285 B X |
| 4,318,512 | 3/1982 | Jacobson et al. | 241/189 R X |

*Primary Examiner*—Howard N. Goldberg
*Assistant Examiner*—Timothy V. Eley
*Attorney, Agent, or Firm*—Kinzer, Plyer, Dorn & McEachran

[57] ABSTRACT

A rotary granulator having a rotor positioned coaxially within a cutting chamber defined by a multi-perforate cylindrical screen mounted on an end plate with a fixed bed knife projecting into the cutting chamber in position to cooperate with a rotor knife in cutting up stock introduced axially into the cutting chamber through the end of the chamber opposite the end plate. The rotor includes a hub adjacent the end plate and at least two spaced rotor arms projecting from the hub parallel to the cutting chamber axis with the rotor knife mounted on a rotor arm. An annular rotor bearing member is mounted on the ends of the rotor arms opposite the hub within a fixed bearing member; the two bearing members comprise an outboard guide/support bearing for the rotor, affording support for the rotor but allowing unimpeded axial feed into the cutting chamber. A housing around the screen defines a separation chamber for granulated stock passing through the screen, with egress passages from the separation chamber into an annular exit chamber housing a rotary impeller that propels a stream of air and granulate through the cutting chamber, the screen, the separation chamber and the exit chamber, and out through a discharge opening.

26 Claims, 10 Drawing Figures

4
4
20
22
24
25
25
26
26
27
30
31
32
33
40
41
41
42
42
43
43
44
44
45
45
46
46
48
49
50
51
52
52
53
55
55
56
61
61
63
64
66
77
77
91
92
93
93
97
98
99
101
102
103
104
105
106
107
108
109
110
111
112
113
113
114
114
119
119
120
130
B
C

Fig. 5.
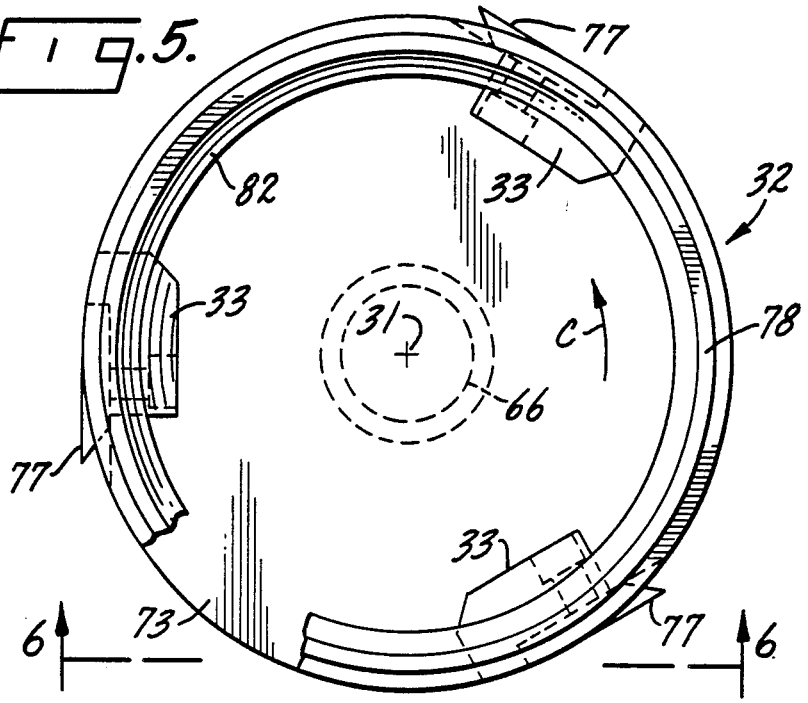
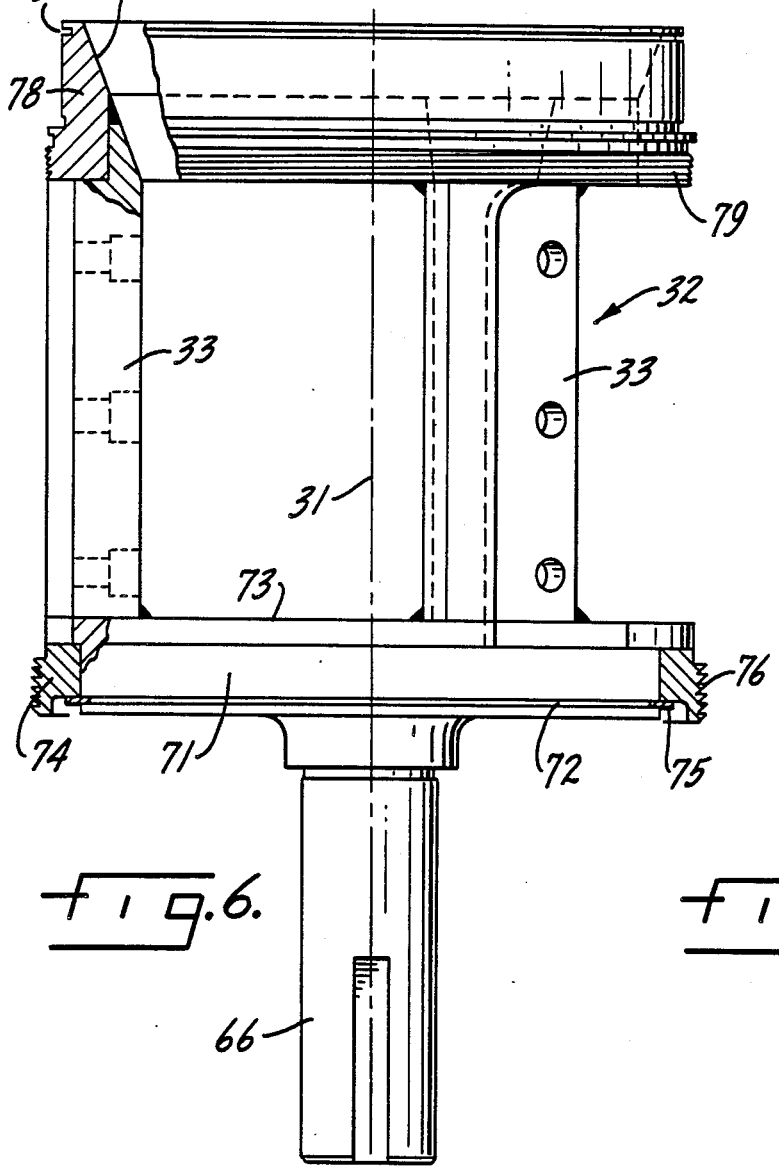
Fig. 6.
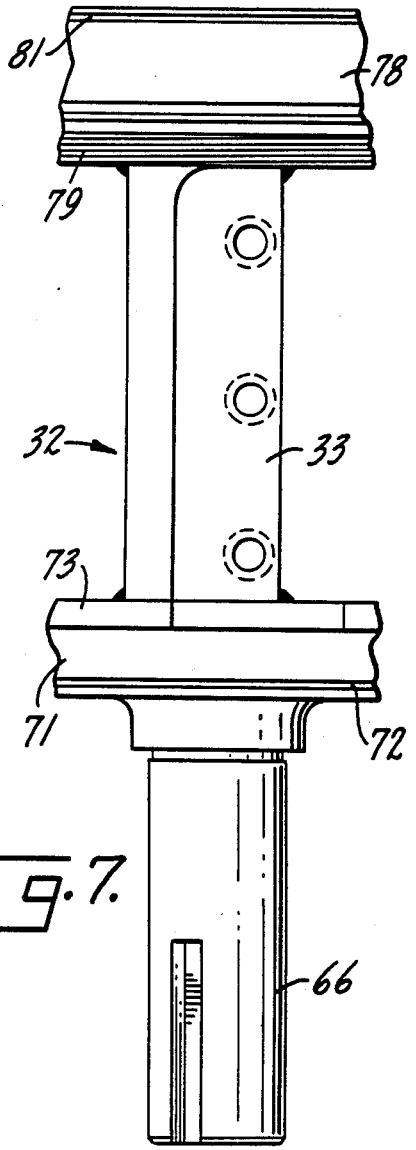
Fig. 7.

Fig. 9.
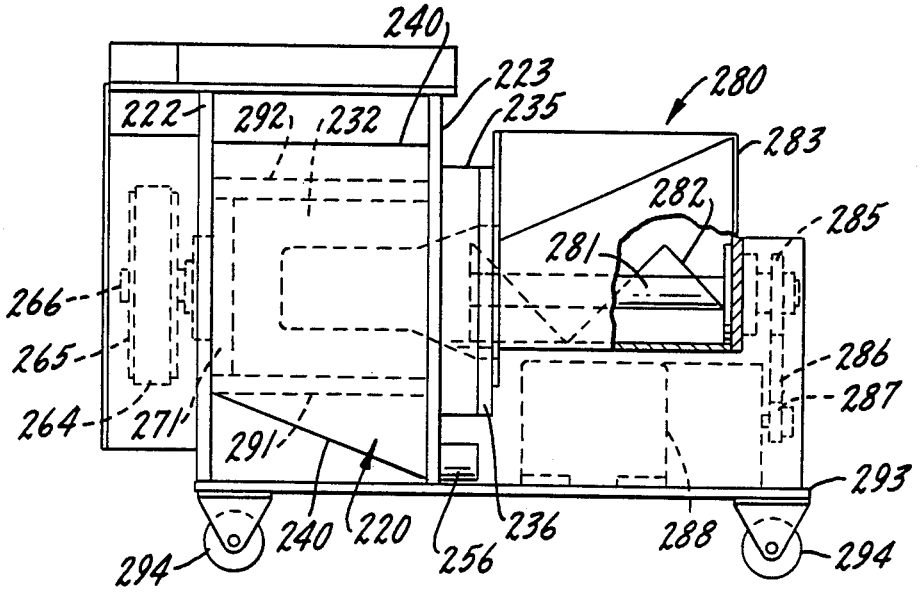
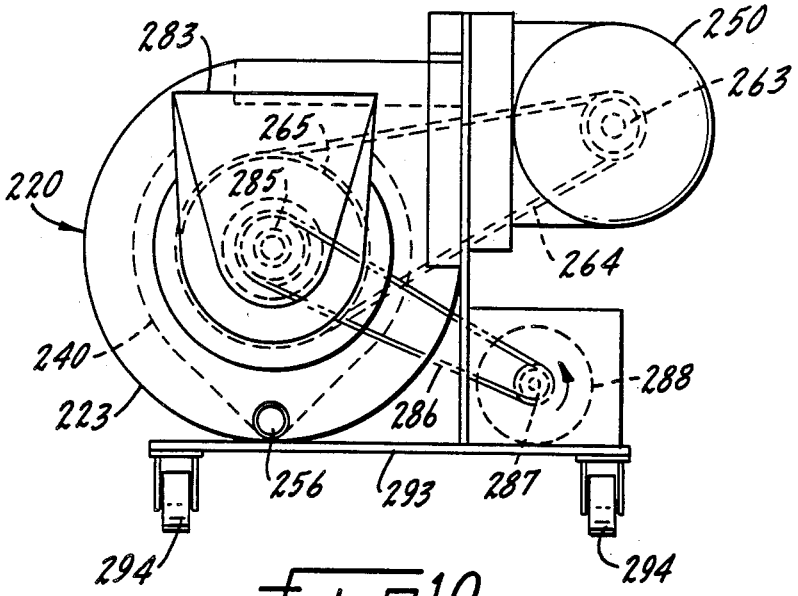
Fig. 10.

ROTARY COMMINUTOR

BACKGROUND OF THE INVENTION

Rotary granulators for cutting up plastics and other like materials, reducing such materials to granular form for re-use or other disposition, are well known in the art. One rotary granulator construction that has been widely used over a substantial period of time is described in Morin U.S. Pat. No. 3,419,223. A comprehensive review of a variety of granulators is presented in "Cutting Chamber is Key to Improved Granulator Performance" appearing in the journal *Plastics Machinery & Equipment,* April 1983, pages 23, 24 and 26.

In the Morin granulator and in virtually all of the various granulators described in the PM&E article, there is a rotor, carrying two or more rotor knives, disposed in a cutting chamber having a lower portion bounded by a perforate screen of semi-cylindrical configuration. At least one bed knife projects radially into the cutting chamber to cooperate with the rotor knives in cutting (granulating) plastic waste or other stock. The material to be cut up in the granulator is fed radially into the chamber through the open side above the rotor opposite the screen. As the stock in the cutting chamber is reduced to granular form, the granulate passes through the screen and is discharged from the granulator. A vacuum or pneumatic conveyor is usually employed to remove the granulated material.

A few machines have used a similar rotary cutting arrangement but have provided for introduction of stock axially into the cutting chamber, passing through a support for the knives. An axial feed arrangement of this kind has the advantage that a substantial portion of the cutting chamber may be encompassed by the perforate screen, allowing a greatly increased area for discharge of granulate material from the cutting chamber. A device of this kind is the wood chipper described in Pallmann U.S. Pat. No. 3,549,093.

There are a number of continuing problems associated with rotary granulators employed in the comminution of waste plastics and similar materials. Machines of this general kind, particularly the radial feed machines that have been most prevalent in the industry, as exemplified by the machines of the aforementioned Morin patent and the PM&E article, are rather limited in through-put, in part because the cutting chamber exit area afforded by the perforate screen is limited to about 180° or less. Such machines frequently exhibit a tendency toward bounce-back of material from the cutting chamber, with unnecessary recirculation before the granulate is discharged from the cutting chamber through the perforate screen. This recirculation effect can lead to the production of excess fines, the particles in many instances being reduced far more than necessary. An axial feed arrangement as in the aforementioned Pallmann patent affords a partial solution to these difficulties, but the obstructions at the inlet to the cutting chamber limit the size of the pieces of stock that can be fed into the machine and also tend to limit the through-put.

Jamming of granulators is also a common problem. In previously known machines, a failure of the vacuum or pneumatic conveyor used to convey granulated material away from the machine may lead to a rapid build-up of material into the area of the screen. If this condition continues for an appreciable period of time, the plastic material being granulated may agglomerate in the screen area, with a potential for substantial damage.

Another common jamming problem of conventional granulators is the jamming or wedging of unground plastic parts or pieces between the screen or knives and the rotor shaft or core. This condition produces damage and deformation of the screen, or full stopping of the granulator rotor.

Rotary granulators, as heretofore known, have also suffered from a substantial noise problem. This noise is in part due to intermittent movements of air through the rotating knives of the machine. Yet another difficulty associated with conventional granulator constructions pertains to the lack of a single design suitable for varying orientations to fit the requirements of varying applications in which the granulator may be employed. That is, the conventional granulator is intended for orientation in just one direction, with the rotor and cutting chamber aligned horizontally; a single design has not been suitable for both vertical and horizontal orientations and the many possible intervening orientations.

SUMMARY OF THE INVENTION

It is an object of the present invention, therefore, to provide a new and improved rotary granulator that affords a high through-put of material being granulated, with reduced likelihood of jamming and with a low operational noise level.

A further object of the invention is to provide a new and improved rotary granulator in which recirculation of material within the cutting chamber is reduced to a minimum with the granulator being usable in any orientation between the vertical and horizontal and adapted to use with a wide variety of input feeders including augers, conveyors, and simple gravity feed hoppers.

Another object of the invention is to provide a new and improved rotary granulator that affords egress of granular material from the cutting chamber through a perforate screen constituting a substantially complete cylinder, interrupted only by the bed knife or knives, and that affords a continuous airstream, generated by the granulator, for transferring granulate out of the cutting chamber through the screen and out through a discharge opening from the machine.

A specific object of the invention is to provide a new and improved rotary granulator that is inexpensive yet sturdy in construction and that allows for easy access to the interior of the granulator for maintenance purposes.

Accordingly, in one aspect the invention relates to a rotary granulator comprising a frame including an end frame member and a plurality of parallel spaced side frame members projecting from the end frame member, a multi-perforate cylindrical screen mounted on the frame and defining a cylindrical cutting chamber having an axis normal to the end frame member, and a bed knife mounted on the frame and projecting into the cutting chamber. A rotor, positioned within the cutting chamber, comprises a hub positioned adjacent the end frame member, a plurality of spaced rotor arms projecting from the hub parallel to the cutting chamber axis but adjacent the periphery of the cutting chamber, and at least one rotor knife mounted on a rotor arm in position to cooperate with the bed knife in cutting stock introduced into the cutting chamber. A guide and support bearing is provided for the rotor, comprising an annular fixed bearing member mounted on the frame and an annular rotor bearing member mounted on the ends of the rotor arms opposite the hub, affording an inlet opening with unimpeded axial feed access into the cutting chamber. Drive means are provided for rotating the rotor.

In another aspect, the invention relates to a rotary granulator comprising an end frame member, a multiperforate cylindrical screen mounted on one side of the end frame member and defining a cylindrical cutting chamber having an axis normal to the end frame member, a bed knife mounted on the frame and projecting into the cutting chamber, and a rotor, positioned within the cutting chamber, including at least one rotor knife positioned to cooperate with the bed knife in cutting up stock introduced into the cutting chamber. A separation chamber housing is mounted on the end frame in spaced encompassing relation to the screen, defining an annular separation chamber for receiving granulated stock passing through the screen. An exit chamber housing is mounted adjacent the separation chamber, defining an exit chamber having a discharge opening, and at least one egress passage is provided for granulated stock, from the separation chamber to the exit chamber. Rotary impeller means propels a stream of air continuously through the cutting chamber, the screen, the separation chamber, the egress passage and the exit chamber and out the discharge opening, the air stream entraining and moving granulate to the discharge opening. Drive means are provided for rotating the rotor and the impeller means.

BRIEF DESCRIPTION OF THE DRAWINGS

FIG. 5 is a plan view of the rotor employed in the granulator of FIGS. 1–4;

FIG. 6 is an elevation view of the rotor, taken approximately as indicated by line 6—6 in FIG. 5;

FiG. 7 is a detail elevation view of a portion of the rotor of FIGS. 5 and 6, from a different position than FIG. 6;

FIG. 9 is a simplified external elevation view of a granulator having a horizontally oriented cutting chamber and equipped with an auger feed, comprising another embodiment of the invention; and FIG. 10 is an end view of the granulator of FIG. 9, taken from the input end.

DESCRIPTION OF THE PREFERRED EMBODIMENTS

Figure 1:
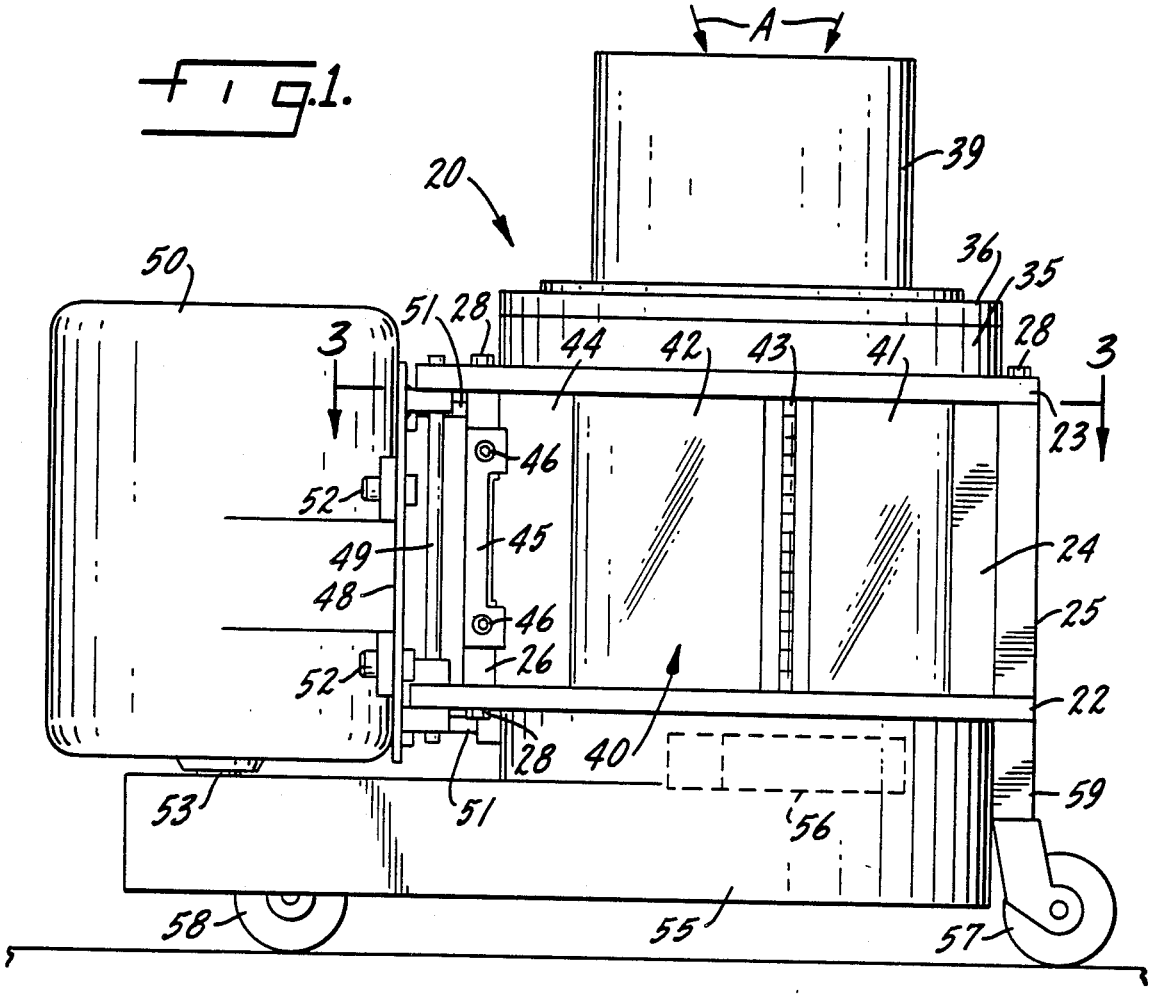
FIG. 1 is a simplified external elevation view of a rotary granulator constructed in accordance with one embodiment of the present invention.
Figure 2:
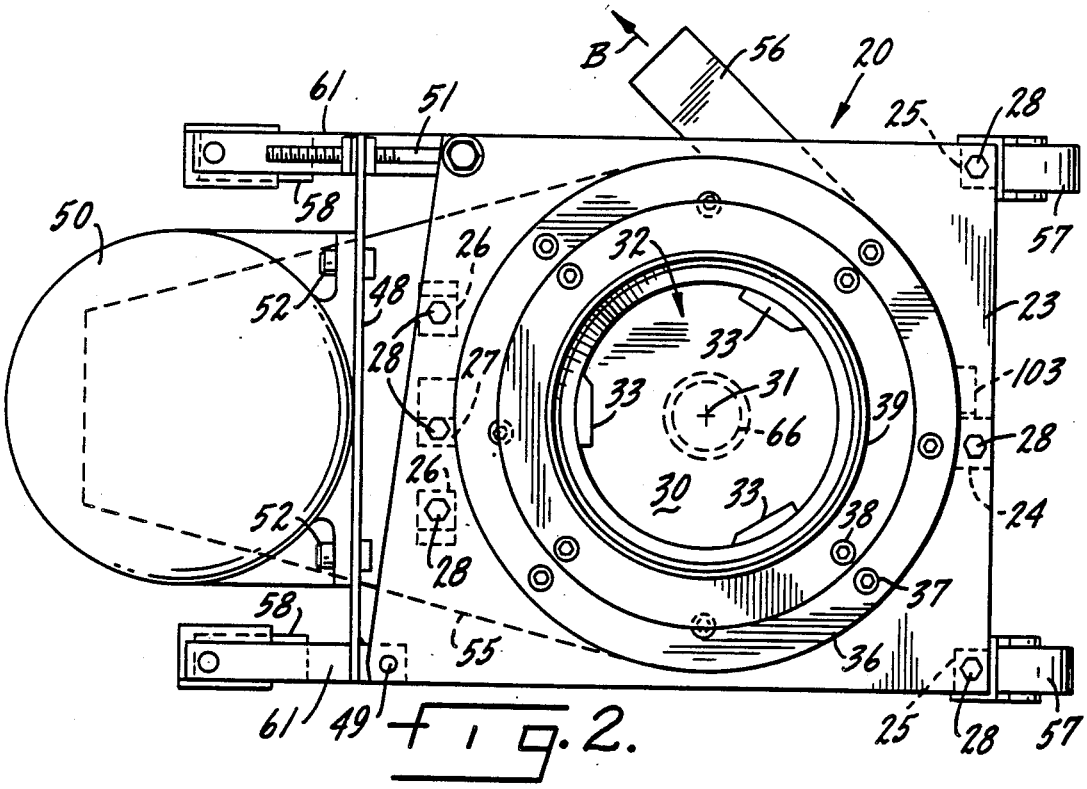
FIG. 2 is a plan view of the granulator of FIG. 1.

FIGS. 1 and 2 provide external elevation and plan views of a rotary granulator 20 constructed in accordance with one preferred embodiment of the present invention. These views are somewhat simplified and are intended only to afford a generalized illustration of the overall construction and operation of the granulator.

Granulator 20 comprises a central frame that includes two end frame members or plates 22 and 23; in the orientation illustrated, plate 22 is the bottom member of the frame and plate 23 is a top member for the frame. Frame members 22 and 23 have the same external configuration; as shown by plate 23 in FIG. 2, the end frame members are generally trapezoidal in shape.

The central frame of granulator 20, FIGS. 1 and 2, further comprises a plurality of parallel spaced side frame members on which the two end plates 22 and 23 are mounted. One of these side frame members is a post 24 located near the center of the right-hand side of the granulator. At this same side of the granulator there are two additional spacer posts or frame members 25, positioned at the corners of the end plates 22 and 23. At the left-hand side of the end frame members 22 and 23, as seen in FIGS. 1 and 2, there are two additional side frame members or posts 26, and another spacer post or side frame member 27 is located intermediate posts 26 (FIG. 2). The side frame members 24–27 are all parallel to each other and perpendicular to the two end plates 22 and 23. All of the side frame members 24–27 are firmly secured to each of the two end frame members 22 and 23 as by a series of cap screws 28. Thus, members 22–27 form a rigid, sturdy frame for granulator 20.

There is a cutting chamber 30 within the frame 22–27 of granulator 20, as generally indicated in FIG. 2, the cutting chamber 30 being symmetrical about an axis 31. A rotor 32 including three equally spaced rotor arms 33 is mounted in cutting chamber 30, and three rotor knives (not shown) are carried by the rotor arms. The use of three rotor arms 33 is not essential; rotor 32 could also be constructed in a balanced arrangement with two rotor arms 33 or with four or even more rotor arms if desired. To keep the rotor balanced, it is preferable to have each rotor arm carry a rotor knife.

The top of the cutting chamber in granulator 20 is bounded by a bearing ring 35 and an annular bearing cap 36 which covers the bearing ring. Bearing ring 35 and cap 36 are mounted on the top end frame member 23 by appropriate means such as the recessed cap screws 37 and 38 (FIG. 2). An annular inlet chute 39 may be mounted on granulator 20, above bearing cap 36.

The central portion of granulator 20, within frame 22–27, is enclosed by a substantially cylindrical separation chamber housing 40 (FIG. 1). Each side of housing 40 is constructed as two arcuate housing members 41 and 42 joined by a hinge 43. The edge of housing member 41 opposite hinge 43 is secured to frame member 24 by appropriate means (not shown). The portion of housing member 42 opposite hinge 43 includes a projecting integral extension 44 that is mounted upon one of the frame members 26 by a clamp member 45 and a pair of screws 46. The portion of housing 40 shown in Fig. 1, comprising members 41–46, is duplicated on the opposite side of granulator 20.

A motor base plate 48 extends transversely of granulator 20 at the left-hand side of the granulator as seen in FIGS. 1 and 2. One end of the motor base plate 48 is pivotally mounted upon a shaft 49 that extends vertically between the two end plates 22 and 23. At the side of plate 48 opposite its pivotal mounting to shaft 49, the motor base plate is engaged by two eye-bolts 51 to afford an adjustment in the angular position of plate 48 relative to the main frame 22–27 of the granulator. A drive motor 50 is mounted upon plate 48 by suitable means such as a series of bolts 52.

As shown in FIG. 1, the shaft 53 of motor 50 extends downwardly into one end of a housing 55 at the base of granulator 20. As described and illustrated hereinafter, motor 50 drives a belt that in turn drives the granulator rotor 32. The drive belt is located entirely within housing 55, which encompasses the operating mechanism of the granulator below the end frame member 22. Thus, housing 55 encloses an exit chamber below end plate 22, the exit chamber being provided with a discharge opening feeding a conduit 56.

Granulator 20, as illustrated in FIGS. 1 and 2, is a portable device mounted upon two pairs of casters 57 and 58. The casters 57 at the right-hand side of granulator 20, as shown in FIGS. 1 and 2, are mounted in mounting blocks 59 that extend downwardly from the bottom end plate 22. The casters 58 at the left-hand side of the granulator are mounted on two supports 61. In each case, a pivotal mounting arrangement is provided for the casters to permit rolling movement in any desired direction.

A brief, generalized description of operation of granulator 20 can now be presented, based on FIGS. 1 and 2. Scrap plastic or other stock material to be comminuted for re-use or other disposition is introduced axially into cutting chamber 30 through chute 39 as generally indicated by arrows A in FIG. 1. If the stock requiring granulation is too large to enter chute 39, it may be cut or chopped into chunks prior to being fed into the granulator. Because the inlet end of cutting chamber 30 is open and unimpeded, however, relatively large pieces of stock can readily be fed into chamber 30.

In cutting chamber 30, the rotary motion of rotor 32, driven by motor 50, impels the pieces of scrap outwardly toward knives mounted on rotor arms 33. The rotor knives cooperate with a fixed bed knife, (described later) to cut up the stock. Cutting chamber 30 is bounded by a cylindrical perforated screen, as described in connection with FIGS. 3 and 4; when the stock has been sufficiently reduced in size it passes through that screen, again aided by centrifugal force due to rotation of rotor 32, into an annular separation chamber defined by housing 40. From the separation chamber, the granulate passes through a series of egress passages in the bottom end frame member 22 into an exit chamber in housing 55, from which the granulate is impelled outwardly through discharge conduit 56, as indicated by arrow B in FIG. 2. The exit chamber in housing 55 incorporates a rotary impeller fan, described hereinafter, that maintains a continuous flow of air through the entire granulator, passing into inlet chute 39 and out through discharge conduit 56, as described below.

Figure 3:
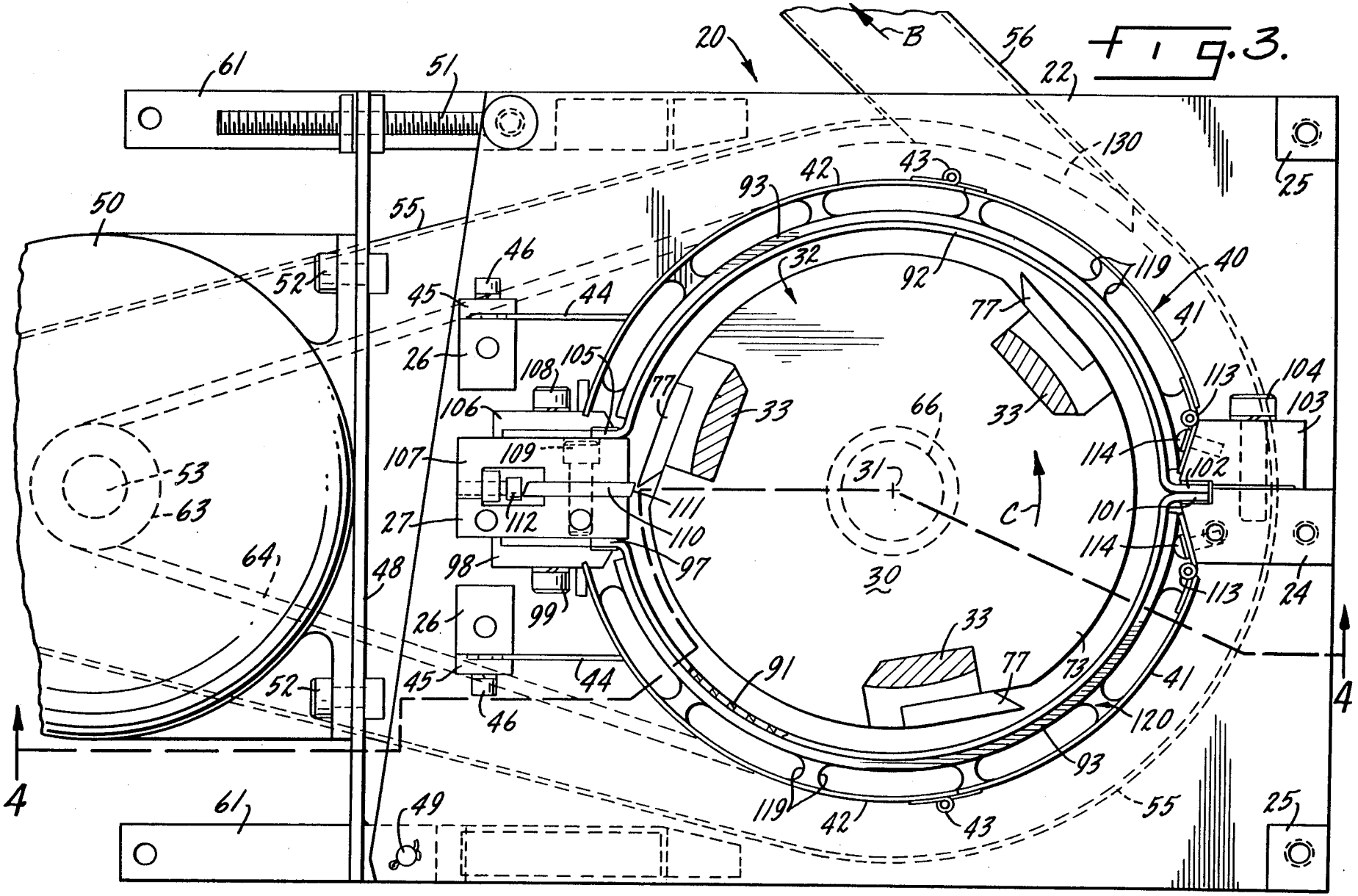
FIG. 3 is a section view, on an enlarged scale, taken approximately along line 3—3 in FIG. 1, looking downwardly into the granulator chamber.
Figure 4:
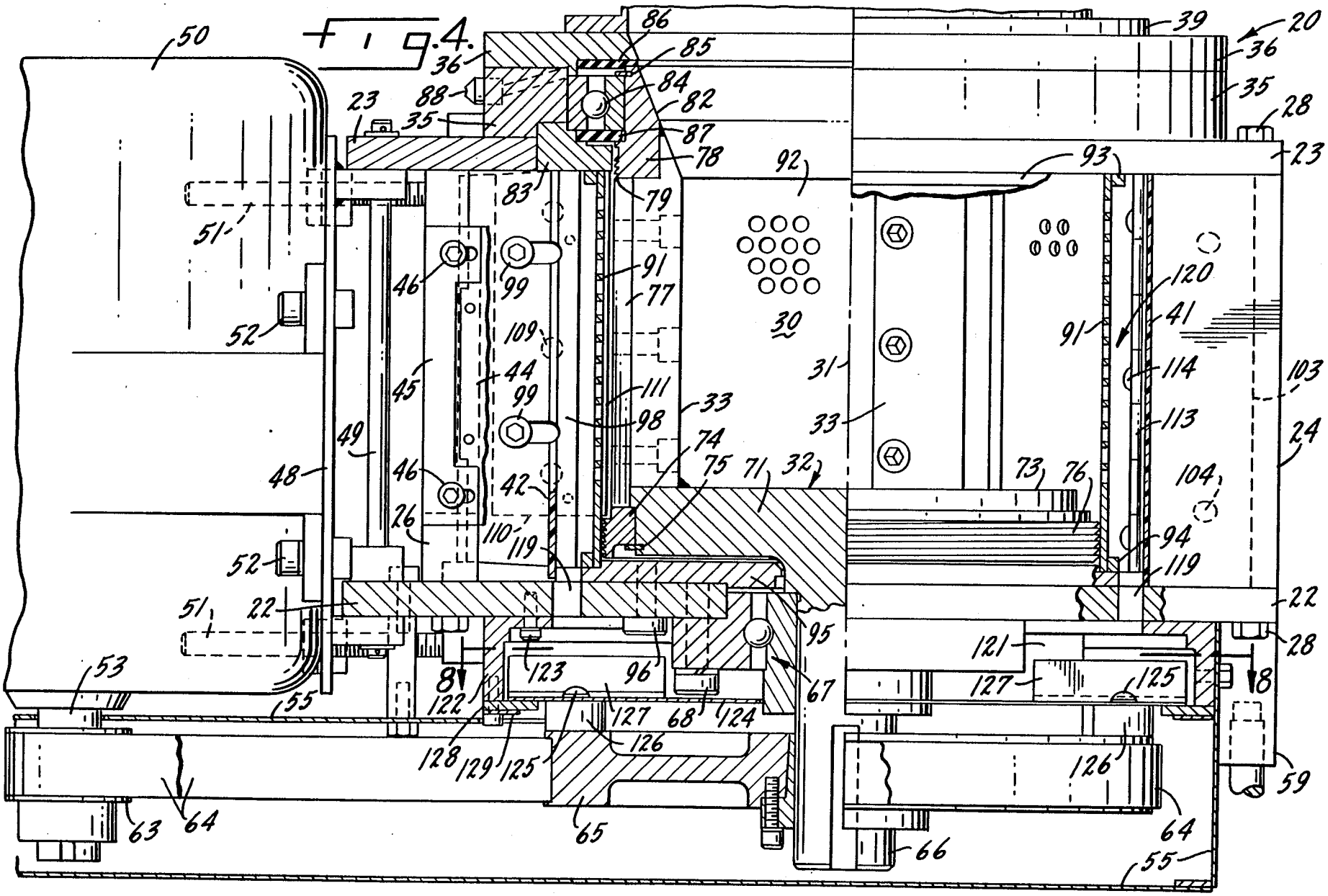
FIG. 4 is a sectional elevation view, on the same scale as FIG. 3, taken approximately along line 4—4 in FIG. 3.
Figure 8:
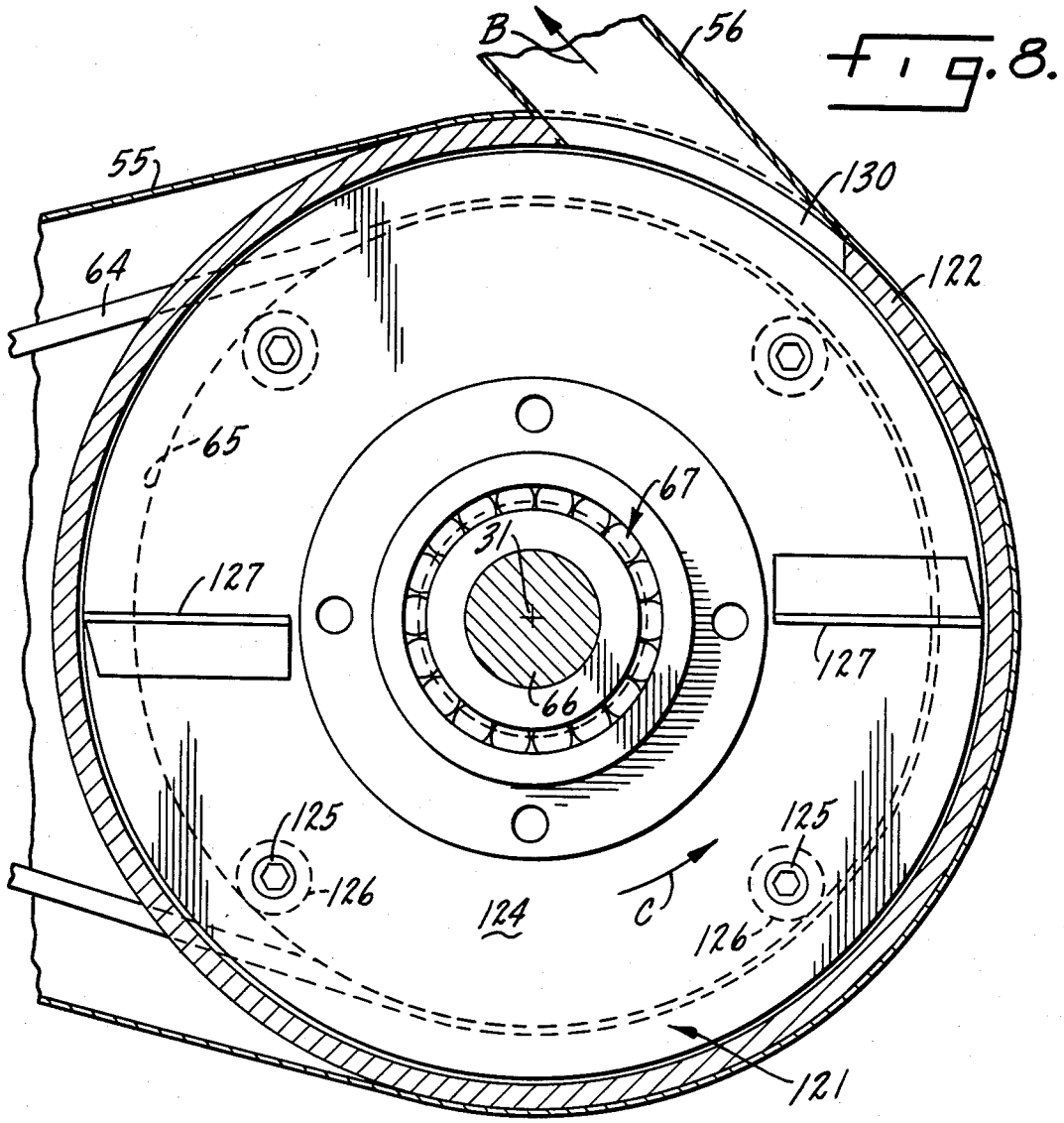
FIG. 8 is a sectional view of the base of the granulator of FIGS. 1–4, taken approximately as indicated by line 8—8 in FIG. 4.

The unique internal construction of granulator 20 is shown in detail in FIGS. 3, 4 and 8, with the construction of rotor 32 further illustrated in FIGS. 5–7.

As shown in FIGS. 3 and 4, a sheave 63 is mounted on motor shaft 53 and is engaged by a drive belt 64. Drive belt 64 also extends into engagement with a substantially larger sheave 65 affixed to a rotor shaft 66 that is an integral part of rotor 32. Thus, motor 50, belt 64, and the two sheaves 63 and 65 afford a drive means for rotating the rotor 32 of granulator 20.

Rotor shaft 66 is journalled in an anti-friction thrust bearing 67 mounted in a central opening in the bottom end plate 22 of granulator 20 as shown in FIG. 4. A ball bearing is preferred, as shown. The outer race of bearing 67 is mounted in a central aperture in end frame member 22 by appropriate means such as a series of cap screws 68. The inner race of bearing 67 is affixed to shaft 66 by appropriate means (not shown).

The construction of rotor 32, which is of substantial importance in realizing the performance improvements of the present invention, is best illustrated in FIGS. 5–7. As shown therein, rotor shaft 66 is formed integrally with and extends axially from a hub 71. Hub 71, as shown, is a disc having an external groove 72. The upper part of hub 71 constitutes an integral disc 73 of slightly enlarged diameter. A ring 74 having an external seal thread 76 is mounted on rotor hub 71 by means of a retainer ring 75 that engages in groove 72.

Three parallel spaced rotor arms 33 are welded to and project upwardly from the upper disc portion 73 of hub 71. In rotor 32, each arm 33 serves as a support for a rotor knive 77. The knives 77 are shown mounted on rotor 32 only in FIG. 5. Knives 77 are removably mounted, by means of a plurality of screws or like fasteners, on each of the rotor arms 33, facilitating replacement of the knives when they become worn with continuing use.

Rotor 32 includes an annular rotor bearing member 78 welded or otherwise affixed to the ends of rotor arms 33 opposite hub 71. The lower skirt portion of ring 73 is provided with an external seal thread 79. An annular groove 81 is formed in the outer surface of ring 78, near the top of the ring. The configuration of bearing ring 78 is such as to afford an internal sloping surface 82 leading downwardly into the interior of the rotor; see FIG. 6. The axis of the rotor coincides with the axis 31 of cutting chamber 30.

A fixed bearing member or ring is mounted on the top plate 23 that constitutes one end frame member in the central frame of granulator 20. This fixed bearing member, in the illustrated construction, actually comprises three concentric rings, a lower ring 83 and the superimposed bearing ring 35 and bearing cap ring 36. A ball bearing 84 connects this fixed bearing structure 35, 36, 83 to the rotor bearing member 78. The outer race of bearing 84 is trapped between bearing cap 36 and ring 83, whereas the inner race of bearing 84 is secured to the rotor bearing member 78 by a retainer ring 85. Upper and lower annular seals 86 and 87 are provided for bearing 84, and an appropriate lubrication fitting 88 is also provided. Threads 76 and 79 at the opposite ends of rotor 32 are used to preclude migration of granules into the area of the rotor bearings 67 and 84, respectively.

In granulator 20, the periphery of the cylindrical cutting chamber 30 is defined by a multi-perforate cylindrical screen formed by two semi-cylindrical screen members 91 and 92. The upper edge of each of the two screen members 91 and 92 comprises a flange 93 that engages the lower surface of ring 83, a surface that is essentially coplanar with the bottom surface of end frame member 23 (FIG. 4). The bottom edge of each of the two screen members includes a flange 94 seated on an annular spacer 95 that is in turn mounted upon the lower end frame member 22 by suitable means such as a plurality of cap screws 96.

As best shown in FIG. 3, one end 97 of screen member 91 is secured to the side frame member 27 by a clamp member 98 mounted on frame member 27 by suitable means such as a plurality of screws 99. The other end 101 of screen member 91 and the corresponding end 102 of screen member 92 are mounted upon side frame member 24 by a clamp member 103 secured to frame member 24 by appropriate means such as a plurality of screws 104. The other end 105 of screen member 92 is mounted between two clamp members 106 and 107, utilizing appropriate fastening means such as a plurality of screws 108. Clamp member 107, in turn, is mounted upon side frame member 27 by appropriate means such as a plurality of cap screws 109.

A bed knife 110 is positioned between the clamp member 107 and side frame member 27 (FIG. 3). One edge 111 of bed knife 110 projects a short distance radially into cutting chamber 30, in position to cooperate with the rotor knives 77 in cutting up stock that is introduced into cutting chamber 30. The opposite edge of bed knife 110 is engaged by an adjustment screw 112 which can be utilized to advance the bed knife into the cutting chamber to compensate for wear on the bed knife.

As shown in FIG. 3, the end of each housing member 41 adjacent side frame member 24 is affixed to a hinge 113. One hinge 113 is mounted directly upon frame member 24 by suitable means such as a plurality of screws 114. The other hinge 113 is mounted upon clamp member 103 in the same manner. At the opposite ends of the two semi-cylindrical halves of housing 40, the arcuate housing members 42 each engage one of the screen clamp members 98 and 106. The arcuate housing members 41 and 42 and their integral extensions 44 are preferably formed of molded resin, though sheet metal may be used for housing 40 if desired.

As will be apparent from FIG. 3, the multi-perforate screen formed by members 91 and 92 is a substantially complete cylinder, interrupted only by the support 27,107 for bed knife 110 and to a much lesser extent by the frame and clamp structure 24,103 at the opposite side of the screen. The housing 40 formed by housing members 41 and 42, on the other hand, in conjunction with screen 91,92 defines an annular separation chamber 120 completely encompassing the perforate screen. From chamber 120, there are a plurality of egress passages 119, formed as apertures through end plate 22, that lead from the separation chamber 120 to an exit chamber 121 on the opposite side of end frame member 22, as seen in FIG. 4.

The circumference of exit chamber 121 is defined by an annular guard ring 122 (FIGS. 4 and 8) that is mounted on the lower surface of the bottom end frame member 22 by suitable means such as a plurality of screws 123 (FIG. 4). The bottom of exit chamber 121 is closed off by an impeller disc 124 (FIGS. 4 and 8) that is secured to sheave 65 by a plurality of screws 125 extending through spacers 126. Two or more impeller blades 127 are mounted on impeller disc 124, extending upwardly into exit chamber 121. As shown in FIG. 4, an annular seal 128 closes off the periphery of the exit chamber. Seal 128 is held in place by a retainer ring 129 affixed to the lower surface of guard ring 122.

The operational features of granulator 20 may now be described with reference to FIGS. 3 through 8. In operation, motor 50 is energized continuously and rotates both rotor 32 and impeller disc 124 (see arrows C) through sheave 63, belt 64, and and sheave 65. During each revolution of rotor 32, the three rotor knives 77 pass bed knife 110 (FIG. 3), cutting any stock present in this part of cutting chamber 30. The stock in chamber 30, cut and uncut, is impelled continuously around the periphery of cutting chamber 30 and any granulate small enough to pass through the openings in screen members 91 and 92 is impelled outwardly through the screen by centrifugal force, into the separation chamber 120 bounded on its outer periphery by the housing 40 comprising housing members 41 and 42.

The rotary motion of impeller 124, with its blades 127, has a dual effect. All granulate entering exit chamber 121 through the egress passages 119 is swept around the exit chamber 121 by impeller blades 127 and passes into discharge conduit 56 through the discharge opening 130 in guard ring 122 (FIG. 8). The impeller 124,127 also acts as a fan, continously propelling a stream of air through the entire granulator. That is, the impeller fan 124,127 draws a stream of air into the inlet of cutting chamber 30, through the perforations in screen 91,92 into separation chamber 120, through egress passages 119 into exit chamber 121, and out through discharge opening 130 and discharge conduit 56. This air stream entrains the granulated particles and keeps them moving in a continuous discharge from the granulator 20.

Rotor 32, with its "tuning fork" construction, affords a completely unimpeded axial opening into cutting chamber 30 and thus avoids obstruction of entry of stock into cutting chamber 30 as would occur if a support spider or like structure were utilized at the cutting chamber inlet. Nevertheless, the rotor bearing ring 78 assures adequate rigidity and structural integrity for rotor 32. Bearing 84, in conjunction with rotor bearing ring 78 and the fixed bearing members 35,36,83, effectively guides and controls the rotational movement of the outer end of rotor 32.

In the operation of granulator 20, the stock to be granulated is not required to pass through any rotating blades in order to enter cutting chamber 30 and hence cannot be "bounced" back out of the cutting chamber inlet. Although only one bed knife 110 is shown in granulator 20, additional bed knives can be provided to cooperate with rotor knives 77 in cutting up the stock requiring granulation. Once in cutting chamber 30, the stock cannot be driven back out through the chamber inlet by rotor 32. Rather, all stock, both cut and uncut, is impelled only toward the cutting blades 77,110 and toward the perforate screen 91,92 constituting the outer boundary of the cutting chamber, due to the centrifugal force afforded by rotor 32. Unlike most previously known granulators, the effective screen area for transferring granulate from the cutting chamber to the separation chamber encompasses a substantially complete cylinder. As a consequence, as soon as any stock in cutting chamber 30 is reduced to a size small enough to pass through the screen 91,92, it is virtually certain to escape into the separation chamber 120 without additional cutting, avoiding undue "fines" in the granulate.

The continuous flow of air through granulator 20 created by the impeller fan 124,127 is quite advantageous. The air flow acts as a direct assist to the centrifugal force afforded by rotor 32 in impelling granulate outwardly through screen 91,92 and hence out of the cutting chamber. In normal use, a vacuum or pneumatic conveyor is connected to discharge conduit 56 to remove granulate from machine 20 as it is produced. If operation of the take-away conveyor is interrupted, however, granulator 20 is not likely to be damaged by a buildup of material within the granulator, due to the direct action of the rotary impeller 124,127 in sweeping granulate out into conduit 56 aided by the air flow induced by the impeller fan. The motion of rotor 32 creates a vortex in the center of cutting chamber 30, with air flow outwardly from that vortex, aiding the impeller fan. The air stream effectively entrains the material as it is granulated and keeps the granulate flowing out of the granulator.

In most instances, granulator 20 is operated in a dry condition. On the other hand, the illustrated construction can be used with a lubricant or water introduced into cutting chamber 30 along with the stock to be granulated. Thus, granulator 20 can function as a "hot melt" granulator in which molten or warm plastic is introduced into the cutting chamber together with a cooling water bath or spray mist.

The location of discharge conduit 56 and the opening 130 in guard ring 122 (FIGS. 3 and 8) are not critical. Opening 130 can be located at virtually any desired orientation around the periphery of guard ring 122. This makes it possible to arrange discharge conduit 56 to project outwardly from the granulator at virtually any desired orientation.

As described and illustrated in FIGS. 1–8, granulator 20 is oriented with the cutting chamber and rotor axis 31 in a vertical alignment. With this arrangement, a simple gravity feed into the open upper end of cutting chamber 30 can be utilized. Stock can be introduced into cutting chamber 30 manually, by a conveyor or auger discharging into chute 39, or by any other suitable arrangement. It is equally practical, however, to orient granulator 20 with the cutting chamber and rotor axis 31 in a horizontal alignment. The principal change involves mounting casters or like supports on the right-hand side of the main frame of the granulator, as viewed in FIGS. 3 and 4, eliminating the caster support arrangement that is shown in FIGS. 1 and 2. With this change of orientation, granulator 20 functions in the same manner as described above, except that stock is now fed into the granulator horizontally instead of vertically. Indeed, granulator 20 functions satisfactorily with axis 31 aligned at any desired angle from vertical (as shown) to horizontal.

Granulator 20 is characterized by quietness in operation as compared with more conventional machines. The air flow into cutting chamber 30 does not pass through the rotor blades or through any rotating blade supports. The same is true of stock entering the cutting chamber. As a consequence, noise is materially reduced.

For maintenance, housing 40 can be opened completely by removing clamp members 45 and pivoting both halves of the housing to an open position, using hinges 43 and 113. This exposes the screen 91,92. The screen itself is readily removed to expose rotor 32 by simply removing clamp members 98 and 106, permitting adjustment or change of rotor knives 77 and cleaning of the granulator interior.

FIGS. 9 and 10 illustrate a further modification of the invention, comprising a granulator 220 that incorporates the same basic construction as described above for granulator 20 except that the egress passages through the one end frame member are eliminated and the impeller fan is not employed.

Thus, granulator 220 utilizes a drive motor 250 to drive an open 'tuning fork' rotor 232 having a hub 271 and shaft 266 through a drive train comprising a sheave 263, a belt 264, and a rotor sheave 265. As in the previous construction, rotor 232 includes an outer bearing ring engaged by a fixed bearing member 235 which may be provided with an annular cap 236. The main frame for granulator 220 again includes two end frame members, plates 222 and 223 arranged in the same configuration as in the previous embodiment. In this instance, granulate passing through the cylindrical screen 291,292 is collected in a chute formed by the housing 240 of the granulator and is discharged through an external discharge conduit 256.

An auger feed device 280 is utilized with granulator 220. The auger feed mechanism includes a shaft 281 extending coaxially with the granulator shaft 266 and thus extending coaxially into the cutting chamber of granulator 220. A continuous helical auger blade 282 on shaft 281 feeds stock from an inlet hopper 283 axially into the cutting chamber of granulator 220. Shaft 281 may be driven by an auger drive comprising a sheave 285, a drive belt 286, a sheave 287, and an auger drive motor 288.

Granulator 220 affords all of the advantages of the previously described granulator 20 except that it does not incorporate the combination impeller and fan of the previously described embodiment. Auger 282 feeds stock horizontally into the cutting chamber of the granulator. The entrance to the granulator cutting chamber, bounded by screen 291,292 is completely open and unimpeded, due to the open rotor and ring bearing construction. As before, material that has been cut to granules small enough to pass through the cutting chamber screen is able to exit from the cutting chamber around its entire periphery. The entire mechanism, comprising granulator 220 and auger mechanism 280, can be mounted upon a single platform 293. If portability is desired, platform 293 may be supported on appropriate casters 294.

We claim:

1. A rotary granulator comprising:

a frame including an end frame member and a plurality of parallel spaced side frame members projecting from the end member;

a multi-perforate cylindrical screen mounted on the frame and defining a cylindrical cutting chamber having an axis normal to the end frame member;

a bed knife mounted on the frame and projecting into the cutting chamber;

a rotor, positioned within the cutting chamber, comprising a hub located adjacent the end frame member, a plurality of spaced rotor arms projecting from the hub parallel to the cutting chamber axis but adjacent the periphery of the cutting chamber, and at least one rotor knife mounted on a rotor arm in position to cooperate with the bed knife in cutting stock introduced into the cutting chamber;

a guide and support bearing for the rotor, comprising an annular fixed bearing member mounted on the frame and an annular rotor bearing member mounted on the ends of the rotor arms opposite the hub, affording an inlet opening with unimpeded axial feed access into the cutting chamber across substantially the full cutting chamber diameter;

and drive means for rotating the rotor.

2. A rotary granulator according to claim 1 in which:

the rotor further comprises a shaft projecting from the rotor hub through a central aperture in the end frame member; and the drive means is connected to the rotor shaft on the side of the end frame member opposite the rotor hub.

3. A rotary granulator according to claim 2 in which:

the screen comprises two multi-perforate screen members, each of essentially semi-cylindrical configuration; and the opposite ends of each of the screen members are mounted upon two side frame members located at diametrically opposite sides of the cutting chamber.

4. A rotary granulator according to claim 3 in which the bed knife is mounted on one of the side frame members on which the screen members are mounted.

5. A rotary granulator according to claim 1 and further comprising:

an imperforate cylindrical separation chamber housing mounted on the frame in spaced encompassing relation to the screen to define a separation chamber encompassing the cutting chamber for receiving granulate passing through the screen; and granulate discharge means for discharging granulate from the separation chamber.

6. A rotary granulator according to claim 5 and further comprising:

impeller means, incorporated in the granulate discharge means, for maintaining a continuous flow of air through the cutting chamber, the screen, and the separation chamber to entrain granulate and aid in its discharge.

7. A rotary granulator according to claim 6 in which:

the rotor further comprises a shaft projecting from the rotor hub through a central aperture in the end frame member; and the drive means is connected to the rotor shaft on the side of the end frame member opposite the rotor hub.

8. A rotary granulator according to claim 7 and further comprising:

an exit chamber housing mounted on the side of the end frame member opposite the rotor hub, defining the periphery of an exit chamber axially aligned with the cutting chamber; and a plurality of granulate egress passages from the separation chamber to the exit chamber, through the end frame member;

the impeller means comprising a rotary impeller mounted in the exit chamber and rotated by the drive means.

9. A rotary granulator according to claim 8 in which:

the rotary impeller comprises an impeller disc mounted on the rotor shaft for rotation therewith, the disc closing off the side of the exit chamber opposite the end frame member, and a plurality of impeller blades mounted on the impeller disc.

10. A rotary granulator according to claim 9 in which:

the screen comprises two multi-perforate screen members, each of essentially semi-cylindrical configuration; and the opposite ends of each of the screen members are mounted upon two side frame members located at diametrically opposite sides of the cutting chamber.

11. A rotary granulator according to claim 5 in which the separation chamber housing comprises two semi-cylindrical housing segments each hingedly mounted on one of the side frame members.

12. A rotary granulator according to claim 11 in which each separation housing segment comprises two arcuate housing members hinged to each other.

13. A rotary granulator according to claim 12 in which:

the screen comprises two multi-perforate screen members, each of essentially semi-cylindrical configuration; and the opposite ends of each of the screen members are mounted upon two side frame members located at diametrically opposite sides of the cutting chamber, and in which one of the two side frame members on which the screen members are mounted is the side frame member on which the two separation housing segments are hingedly mounted.

14. A rotary granulator according to claim 13 and further comprising:

impeller means, incorporated in the granulate discharge means, for maintaining a continuous flow of air through the cutting chamber, the screen, and the separation chamber to entrain granulate and aid in its discharge.

15. A rotary granulator according to claim 14 in which:

the rotor further comprises a shaft projecting from the rotor hub through a central aperture in the end frame member; and the drive means is connected to the rotor shaft on the side of the end frame member opposite the rotor hub.

16. A rotary granulator according to claim 15 and further comprising:

an exit chamber housing mounted on the side of the end frame member opposite the motor hub, defining the periphery of an exit chamber axially aligned with the cutting chamber; and a plurality of granulate egress passages from the separation chamber to the exit chamber, through the end frame member;

the impeller means comprising a rotary impeller mounted in the exit chamber and rotated by the drive means.

17. A rotary granulator comprising:

a frame including an end frame member;

a multi-perforate cylindrical screen mounted on one side of the end frame member and defining a cylindrical cutting chamber having an axis normal to the end frame member;

a bed knife mounted on the frame and projecting into the cutting chamber;

a rotor, positioned within the cutting chamber, including at least one rotor knife positioned to cooperate with the bed knife in cutting up stock introduced into the cutting chamber;

a separation chamber housing mounted on the frame in spaced encompassing relation to the screen, defining an annular separation chamber for receiving granulated stock passing through the screen;

an exit chamber housing mounted adjacent the separation chamber and defining an exit chamber having a discharge opening;

at least one egress passage for granulated stock from the separation chamber to the exit chamber;

rotary impeller means for propelling a stream of air continuously through the cutting chamber, the screen, the separation chamber, the egress passage, and the exit chamber and out the discharge opening, the air stream entraining and moving granulate to the discharge opening;

and drive means for rotating the rotor and the impeller means.

18. A rotary granulator according to claim 17 in which:

the exit chamber housing comprises a guard ring mounted on the side of the end frame member opposite the cutting chamber; and the rotary impeller comprises an impeller disc closing off the side of the exit chamber opposite the end frame member and a plurality of impeller blades mounted on the impeller disc and projecting into the exit chamber.

19. A rotary granulator according to claim 18 in which:

the rotor includes a rotor shaft projecting through a central aperture in the end frame member and through the exit chamber;

the impeller disc is affixed to the rotor shaft; and a plurality of egress passages extend through the end frame member from the separation chamber to the exit chamber.

20. A rotary granulator according to claim 19 in which the separation chamber housing comprises a plurality of arcuate housing members hingedly mounted on the frame and pivotally displaceable to afford access to the screen.

21. A rotary granulator according to claim 20 in which:

the screen comprises two multi-perforate screen members, each of essentially semi-cylindrical configuration; and the opposite ends of each of the screen members are mounted upon two side frame members located at diametrically opposite sides of the cutting chamber.

22. A rotary granulator according to claim 17 in which the rotor comprises:

a hub positioned adjacent the end frame member; and a plurality of spaced rotor arms projecting from the hub parallel to the cutting chamber axis but adjacent the periphery of the cutting chamber, the rotor knife being mounted on one of the rotor arms;

and the granulator having no members, fixed or rotary, spanning the end of the cutting chamber opposite the end frame member, so as to afford unimpeded axial feed access for introduction of stock into the cutting chamber across substantially the full cutting chamber diameter.

23. A rotary granulator according to claim 22 in which:

the exit chamber housing comprises a guard ring mounted on the side of the end frame member opposite the cutting chamber; and the rotary impeller comprises an impeller disc closing off the side of the exit chamber opposite the end frame member and a plurality of impeller blades mounted on the impeller disc and projecting into the exit chamber.

24. A rotary granulator according to claim 23 in which:

the rotor includes a rotor shaft projecting through a central aperture in the end frame member and through the exit chamber;

the impeller disc is affixed to the rotor shaft; and a plurality of egress passages extend through the end frame member from the separation chamber to the exit chamber.

25. A rotary granulator according to claim 24 in which the separation chamber housing comprises a plurality of arcuate housing members hingedly mounted on the frame and pivotally displaceable to afford access to the screen.

26. A rotary granulator according to claim 25 in which:

the screen comprises two multi-perforate screen members, each of essentially semi-cylindrical configuration; and the opposite ends of each of the screen members are mounted upon two side frame members located at diametrically opposite sides of the cutting chamber.

* * * * *